United States Patent [19]

Hannen et al.

[11] Patent Number: 5,018,339

[45] Date of Patent: May 28, 1991

[54] APPARATUS FOR SHRINK-WRAPPING PALLETIZED GOODS

[75] Inventors: Reiner W. Hannen, Pfalzdorf; Norbert P. Vermeulen, Kleve-Warbeyen; Hans-Theo Pieters, Kleve, all of Fed. Rep. of Germany

[73] Assignee: MSK - Verpackungs-Systeme Gesellschaft Mit Beschrankter, Kleve, Fed. Rep. of Germany

[21] Appl. No.: 540,014

[22] Filed: Jun. 18, 1990

[30] Foreign Application Priority Data

Jun. 22, 1989 [DE] Fed. Rep. of Germany ... 8907610[U]

[51] Int. Cl.[5] ..... B65B 53/02; B65B 53/06

[52] U.S. Cl. ..... 53/557; 156/499

[58] Field of Search ..... 53/442, 557; 156/497, 156/499; 219/388, 400

[56] References Cited

U.S. PATENT DOCUMENTS

| | | | |
|---|---|---|---|
| 3,581,458 | 6/1971 | Gustavsson | 53/557 X |
| 3,662,512 | 5/1972 | Zelnick | 53/557 X |
| 3,710,550 | 1/1973 | Osborne | 53/557 X |
| 3,830,036 | 8/1974 | Harkness et al. | 53/557 X |
| 3,930,790 | 1/1976 | Rogosch | 53/557 X |
| 4,258,533 | 3/1981 | Aka et al. | 53/557 |
| 4,314,141 | 2/1982 | Vangsted et al. | 53/557 X |
| 4,538,363 | 9/1985 | Zagoroff | 53/442 X |
| 4,616,471 | 10/1986 | Hannen | 53/442 |
| 4,866,916 | 9/1989 | Hannen et al. | 53/442 X |

*Primary Examiner*—Robert L. Spruill
*Assistant Examiner*—Daniel B. Moon
*Attorney, Agent, or Firm*—Herbert Dubno; Andrew Wilford

[57] ABSTRACT

An apparatus for shrinking a wrapping about goods carried on a pallet has a transport device defining a support surface for displacing the palletized goods in a transport direction and including an upstream conveyor, a station conveyor spaced downstream by an upstream gap from the upstream conveyor, and a downstream conveyor spaced downstream by a downstream gap from the station conveyor. A heat ring has upstream and downstream portions and side portions extending in the direction therebetween. This ring is displaceable between a lower position with the upstream and downstream portions in the gaps below the surface and the side portions flanking the station conveyor and an upper position above the surface. An actuator displaces the ring between its upper and lower positions. Thus the ring need merely be moved upward once the pallet is positioned on the station conveyor within it to preshrink the wrap and drive out the air in it, then is moved down once to its starting position to fully shrink the wrap in place.

5 Claims, 2 Drawing Sheets

APPARATUS FOR SHRINK-WRAPPING PALLETIZED GOODS

FIELD OF THE INVENTION

The present invention relates to the shrink-wrapping of palletized goods. More particularly this invention concerns a device for shrinking a hood or bag over a stack of goods on a pallet as same moves along a production line.

BACKGROUND OF THE INVENTION

It is standard to shrink-wrap palletized goods in the manner described in U.S. patent application No. 07/454,774 filed Dec. 21, 1989, by first placing a thermoplastic lower foil atop a pallet with edges of the foil projecting laterally past the pallet and then stacking goods on the pallet atop the foil on the pallet within the edges of the foil. The lower edge of a downwardly open heat-shrinkable foil hood is held as the hood is fitted downward over the stack on the pallet until the lower edge is generally below the stack. This lower edge is then gripped below the stack and the foil hood is shrunk from top to bottom around the stack while continuing to grip the lower edge below the stack. Finally the foil hood is welded to the outer edge of the lower foil.

In such an arrangement the pallet is invariably moving horizontally on a transport device, typically a conveyor belt and the hood is heated and shrunk by a vertically displaceable heater ring that can fit around the palletized stack. In order to preliminarily warm and partially shrink the hood to eliminate air trapped therein, the shrink ring is first displaced down over the goods to a lower position where it is activated and then moved up. Once the ring is at the upper end of the goods it is then slowly brought downward, shrinking the hood tightly around the goods. When the wrap is fully shrunk, the ring is lifted up past the top of the stack and the conveyor transports the shrunk-wrap palletized goods horizontally away so that the operation can be repeated with the next load.

Thus for each shrinking operation the shrink ring must execute a useless downward travel from its starting position to the bottom of the goods so that it can do the initial bottom-to-top preshrinking, then after the top-to-bottom final shrinking a second useless upward stroke to get out of the way so a new package can be brought into line. Thus out of the four vertical movements, two are wholly unproductive.

OBJECTS OF THE INVENTION

It is therefore an object of the present invention to provide an improved system for shrink-wrapping palletized goods moving along a conveyor.

Another object is the provision of such an improved system for shrink-wrapping palletized goods moving along a conveyor which overcomes the above-given disadvantages, that is which avoids the above-described useless movements.

SUMMARY OF THE INVENTION

An apparatus for shrinking a wrapping about goods carried on a pallet according to this invention has a transport device defining a support surface for displacing the palletized goods in a transport direction and including an upstream conveyor, a station conveyor spaced downstream by an upstream gap from the upstream conveyor, and a downstream conveyor spaced downstream by a downstream gap from the station conveyor. A heat ring has upstream and downstream portions and side portions extending in the direction therebetween. This ring is displaceable between a lower position with the upstream and downstream portions in the gaps below the surface and the side portions flanking the station conveyor and an upper position above the surface. An actuator displaces the ring between its upper and lower positions.

Thus with the system of this invention the ring need merely be moved upward once the pallet is positioned on the station conveyor within it to preshrink the wrap and drive out the air in it, then is moved down once to its starting position to fully shrink the wrap in place. Both passes of the ring are useful. Furthermore the preshrinking can start the instant the pallet comes to rest in the station within the ring and the pallet can be displaced out of the station and a new one brought in the instant the ring has moved back down into its lower starting and ending position.

According to this invention a drive is connected to the conveyor means for synchronously operating same. Separate drives can also be used. In addition according to this invention the upstream and downstream portions of the ring are provided with rollers level with the support surface in the lower position of the ring. Thus the pallet is supported in the conveyor gaps on these rollers, which can even be set up for crosswise transport of the pallet if desired.

So that the rollers can take the load, a support is provided underneath the ring holding same in the lower position thereof.

DESCRIPTION OF THE DRAWING

The above and other objects, features, and advantages will become more readily apparent from the following, reference being made to the accompanying drawing in which.

SPECIFIC DESCRIPTION

Figure 1:
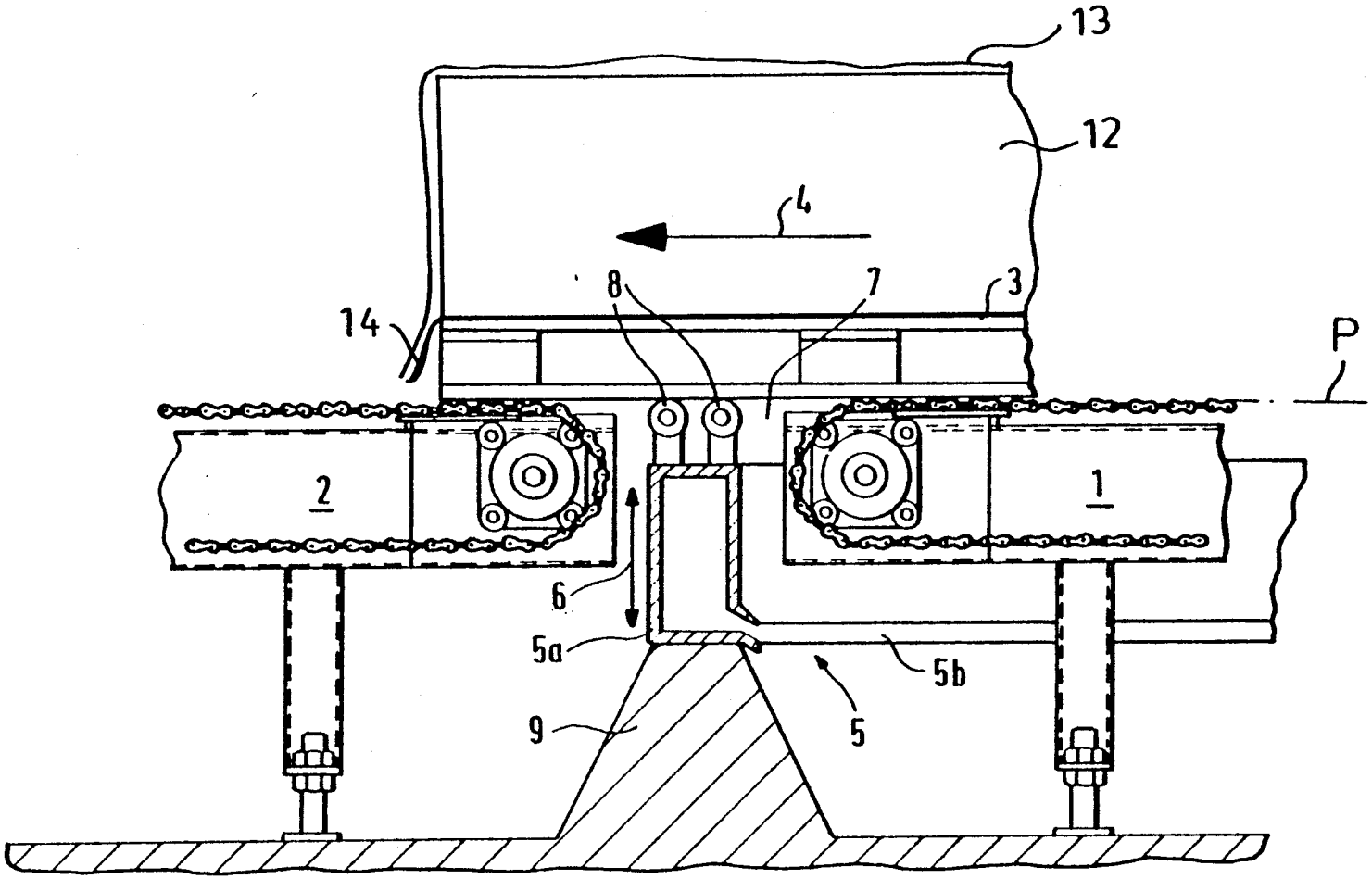
FIG. 1 is a vertical section through a detail of the apparatus of this invention.
Figure 2:
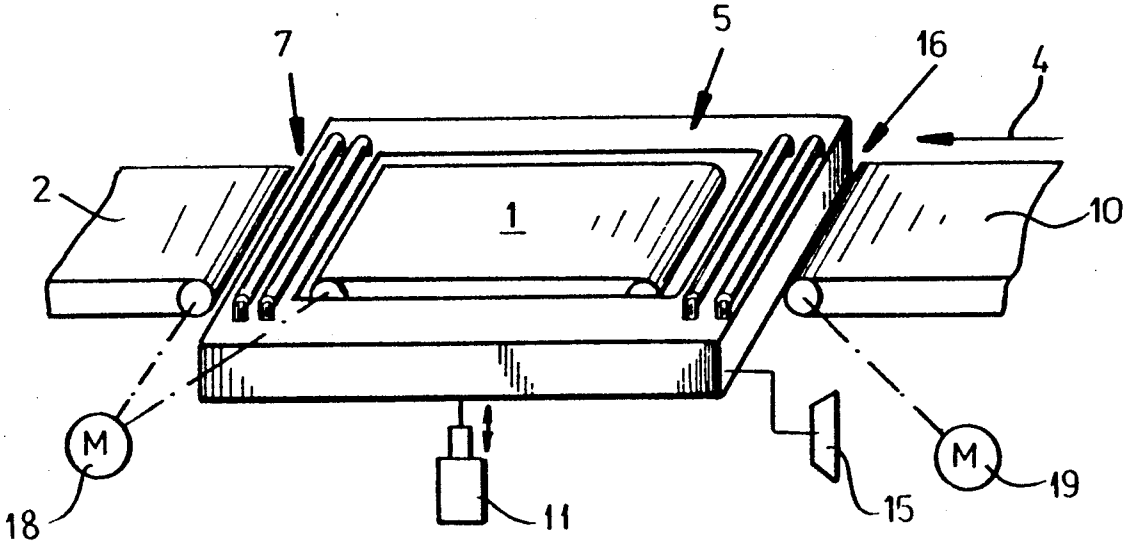
FIG. 2 is a small-scale largely diagrammatic perspective view of the shrink-wrapping apparatus in accordance with the present invention.

As seen in FIGS. 1 and 2 a stack 12 of freight, for instance cases of bottles, is supported on a pallet 3 atop a thermoplastic bottom foil 14. This pallet 3 with its stack 12 is transported in a transport direction 4 along a conveyor comprising an upstream belt conveyor 10, a station conveyor 1 separated from the conveyor 10 by a gap 16, and a downstream conveyor 2 separated by a gap 7 from the station conveyor 1. The conveyors 1, 2, and 10 define a horizontal support plane P (FIG. 1) for the pallet 3. The conveyors 1, 2, and 10 can have a common drive 18 or separate drives 19.

An unillustrated device fits a hood or bag 13 of a thermoplastic foil down over the stack 12 so that the lower edge of this hood 13 lies adjacent the outer edge of the bottom foil 14. This can be done in the station defined by the conveyor 1 or at an upstream location.

A heat-shrink ring 5 is provided which is basically of square shape and is formed as a hollow annular beam 5*a* having an inwardly and downwardly opening mouth 5*b* from which can exit air supplied from a blower 15 and heated by burners or the like inside the beam 5*a*. This ring 5 is mounted on unillustrated guides for movement as indicated by arrow 6 vertically by an actuator 11 between the illustrated lower position and an upper position level with the top of the stack 12. In its lower position the ring 5*a* sits on a stationary support ridge 9 and its upstream and downstream portions which extend horizontally perpendicular to the direction 4 lie in the gaps 7 and 16 below the plane P. Side portions of the ring 5 extending parallel to the direction 4 laterally flank the station conveyor 1. The upstream and downstream sections are each provided with a plurality of rollers 8 that are rotatable about horizontal axes perpendicular to the direction 4 and that ar just tangented by the plane P in the lower position of the ring 5.

According to this invention the bagged and palletized stack 12 is moved by the conveyors 1 and 10 operating synchronously until it sits wholly on the conveyor 1 within the ring 5, which for such movement is in the lower position, and in this position the pallet 3 is stopped. Then the heat of the ring 5 is turned on and it is moved rapidly upward to the top of the stack 12, thereby preshrinking the hood 13 and driving most of the air out of it. Subsequently the ring 5 is moved slowly down to shrink the bag 13 tightly in place and bond it to the edge of the foil 14.

Once the shrinking is complete the ring 5 is dropped down atop the support 9 and the heat is turned off. The conveyors 1, 2, and 10 are then started up to move the shrink-wrapped package off and to bring a new package for heat shrinking into position. Both the exiting and entering pallets will ride on the rollers 8 of the ring 5 as they cross the gaps 7 and 16.

What is claimed is:

1. An apparatus for shrinking a wrapping about goods carried on a pallet, the apparatus comprising:

transport means defining a support surface for displacing the palletized goods in a transport direction and including an upstream conveyor, a station conveyor spaced downstream by an upstream gap from the upstream conveyor, and a downstream conveyor spaced downstream by a downstream gap from the station conveyor;

a heat ring having upstream and downstream portions and side portions extending in the direction therebetween, the ring being displaceable between a lower position with the upstream and downstream portions in the gaps below the surface and the side portions flanking the station conveyor and an upper position above the surface;

respective upstream and downstream rollers on the upstream and downstream portions and level with the support surface in the lower position of the ring; and actuator means for displacing the ring between its upper and lower positions.

2. The shrink-wrapping apparatus defined in claim 1, further comprising drive means connected to the conveyor means for synchronously operating same.

3. The shrink-wrapping apparatus defined in claim 2 wherein the drive means includes respective separate drives for the conveyors.

4. The shrink-wrapping apparatus defined in claim 1, further comprising a support underneath the ring holding same in the lower position thereof.

5. An apparatus for shrinking a wrapping about goods carried on a pallet, the apparatus comprising:

transport means defining a support surface for displacing the palletized goods in a transport direction and including an upstream conveyor belt, a station conveyor belt spaced downstream by an upstream gap from the upstream conveyor belt, and a downstream conveyor belt spaced downstream by a downstream gap from the station conveyor belt;

a heat ring having upstream and downstream portions and side portions extending in the direction therebetween, the ring being displaceable between a lower position with the upstream and downstream portions in the gaps below the surface and the side portions flanking the station conveyor and an upper position above the surface;

means for directing hot gases inwardly from the ring;

rollers on the upstream and downstream portions of the ring level with the surface in the lower position of the ring; and actuator means for displacing the ring between its upper and lower positions while same is directing hot gases inwardly.

* * * * *